US005709042A

United States Patent [19]

Houdroge

[11] Patent Number: 5,709,042

[45] Date of Patent: Jan. 20, 1998

[54] TRACTION DEVICE FOR A SHOE

[76] Inventor: Ali N. Houdroge, 330 NW. Orchard Dr., Portland, Oreg. 97229

[21] Appl. No.: 718,214

[22] Filed: Sep. 20, 1996

[51] Int. Cl.[6] ..... A43C 15/06; A43C 15/04

[52] U.S. Cl. ..... 36/62; 36/67 D; 36/66

[58] Field of Search ..... 36/7.6, 7.7, 7.2, 36/59 R, 62

[56] References Cited

U.S. PATENT DOCUMENTS

| | | | |
|---|---|---|---|
| 382,261 | 5/1888 | Hitchcock | 36/7.6 |
| 990,883 | 5/1911 | Kunz . | |
| 1,032,600 | 7/1912 | Grout . | |
| 1,051,154 | 1/1913 | Norlund . | |
| 1,087,000 | 2/1914 | Duhrkopf . | |
| 1,154,646 | 9/1915 | MacVane . | |
| 1,208,025 | 12/1916 | Smisek | 36/7.7 |
| 1,277,135 | 8/1918 | Schemel . | |
| 1,319,021 | 10/1919 | Thompson . | |
| 1,429,259 | 9/1922 | Tagliaferry . | |
| 1,596,832 | 8/1926 | Heinemann . | |
| 2,547,812 | 4/1951 | Carabatsos | 36/7.7 |
| 3,914,882 | 10/1975 | Greer | 36/7.7 |
| 5,259,125 | 11/1993 | Gromes | 36/7.7 |
| 5,357,692 | 10/1994 | Murray . | |

FOREIGN PATENT DOCUMENTS

| | | | |
|---|---|---|---|
| 535684 | 10/1955 | Belgium | 36/7.7 |
| 2030436 | 5/1992 | Canada | 36/7.6 |

*Primary Examiner*—Paul T. Sewell
*Assistant Examiner*—Anthony Stashick
*Attorney, Agent, or Firm*—Smith-Hill and Bedell

[57] ABSTRACT

A traction device for mounting on a shoe enables a user to walk safely on ice. The traction device includes a pad having an envelope formed by upper and lower fabric layers and having a middle layer of flexible foam material contained within the envelope. An elastic band attached to the envelope surrounds the front portion of the shoe and holds the pad tightly to the shoe's sole. The traction device also includes a set of spike assemblies. Each spike assembly has a tapped receiver that attaches to the middle layer of the pad and a spike having a threaded end that screws into the receiver. The spike also has a pointed tip end that passes through the sheath and engages the ice. An additional layer of resilient material within the envelope cushions the spike assemblies from the shoe and allows each spike assembly an independent range of vertical motion so that the spike assemblies may conform to rough ice surfaces.

12 Claims, 1 Drawing Sheet

TRACTION DEVICE FOR A SHOE

BACKGROUND OF THE INVENTION

1. Field of the Invention

The present invention relates in general to traction devices for enabling people to walk safely on ice and in particular to a traction device that attaches to a shoe.

2. Description of Related Art

Inventors have long sought to develop a comfortable traction device which can be easily attached to a shoe when needed to enable a person to walk on ice without slipping. Unfortunately most of these devices are too bulky to be conveniently carried when not needed, are difficult to install on a shoe, or are unreliable or uncomfortable when used. Many of these devices are also complicated and expensive to manufacture.

U.S. Pat. No. 990,883 issued May 2, 1911 to Kunz, U.S. Pat. No. 1,051,154 issued Jan. 21, 1913 to Norlund, and U.S. Pat. No. 1,596,832 issued Jan. 15, 1926 to Heinemann describe traction devices which attach to the heel of a shoe. These devices are bulky, complicated and expensive to manufacture. They also must be made in various sizes to accommodate heels of various size. They are also attached with buckled leather straps which are often difficult to manipulate in cold weather. Leather straps can also stretch and become loose when wet.

U.S. Pat. No. 1,032,600 issued Jul. 16, 1912 to Grout and U.S. Pat. No. 1,087,000 issued to Duhrkopf describe traction devices formed by spiked leather pads strapped to the sole of a shoe. The spikes are screwed into the leather pads. These devices are also difficult to install because they too require the user to contend with buckles. The traction devices are also unreliable. As the user walks the shoe changes shape, placing continually varying stress on the straps and the pad. The varying stress on the pad gradually wears the holes into which the spikes are screwed. As the holes wear, the spikes begin to wiggle or fall out. These devices are not entirely effective on a rough surface since the leather layers, which must be thick enough to hold the spikes, cannot be flexible enough to allow the spike ends to conform to the rough surface. Thus all spikes may not be in firm contact with the icy surface. Also the limited flexibility of the pads and lack of cushioning effect renders the devices somewhat uncomfortable in use.

U.S. Pat. No. 1,154,646 issued Sep. 28, 1915 to MacVane describes a traction device strapped to the sole of a shoe formed by a spiked metal plate. This rigid device is expensive to produce, uncomfortable to use, and does not conform to rough surfaces.

U.S. Pat. No. 1,319,021 issued Oct. 14, 1919 to Thompson describes a traction device also strapped to the sole of a shoe. The device includes a main leather layer to which several separate reinforcing leather layers have been riveted. Spikes passing though the reinforcing layers have flat heads sandwiched between the main layer and the reinforcing layers. U.S. Pat. No. 1,429,259 issued Sep. 19, 1922 to Tagliaferry describes a traction device having two interlinked spiked metal plates attached to the sole of a shoe. These devices are relatively complicated and expensive to produce and also employ unreliable and hard to use buckled straps for attaching the devices to the shoes.

U.S. Pat. No. 5,357,692 issued Oct. 25, 1994 to Murray describes a rigid traction device that quickly and easily clips onto a shoe but the device is complicated and expensive to produce and its lack of flexibility makes it uncomfortable to wear and less reliable on rough surfaces.

What is needed is a compact, reliable, easy to manufacture traction device that is easily attached to a shoe.

SUMMARY OF THE INVENTION

In accordance with the present invention, a traction device for a shoe enables a user to walk safely on ice. The traction device includes a pad having an envelope formed by upper and lower layers of nylon cloth and having a middle layer of flexible foam material. The middle layer is contained within the envelope, but not attached to it. An elastic band is attached to the upper and lower layers so that the band and pad form a loop snugly surrounding the toe portion of shoe with the pad held tightly to the shoe's sole. The traction device also includes a set of spike assemblies. Each spike assembly has a tapped receiver that attaches to the middle layer of the pad and a spike with a threaded end that screws into the receiver. A pointed tip end of the spike passes through the lower layer of the envelope and engages the ice.

Since the spike receivers are attached to the flexible middle layer, the spike assemblies are free to move up and down as necessary to conform to rough ice surfaces. The elastic band conforms to the shoe so that the pad remains firmly attached to the shoe regardless of changes in the shape of the shoe as the user walks. Although the envelope may flex and stretch as the user walks, such flexing and stretching does not weaken the bond between the spike assemblies and the middle layer because the middle layer floats within the envelope and is not attached thereto.

It is accordingly an object of the invention to provide an effective, reliable traction device for a shoe that is inexpensive to manufacture, easy to install, and easy to carry when not in use.

The concluding portion of this specification particularly points out and distinctly claims the subject matter of the present invention. However those skilled in the art will best understand both the organization and method of operation of the invention, together with further advantages and objects thereof, by reading the remaining portions of the specification in view of the accompanying drawing(s) wherein like reference characters refer to like elements.

BRIEF DESCRIPTION OF THE DRAWING(S)

DESCRIPTION OF THE PREFERRED EMBODIMENT(S)

Figure 1:
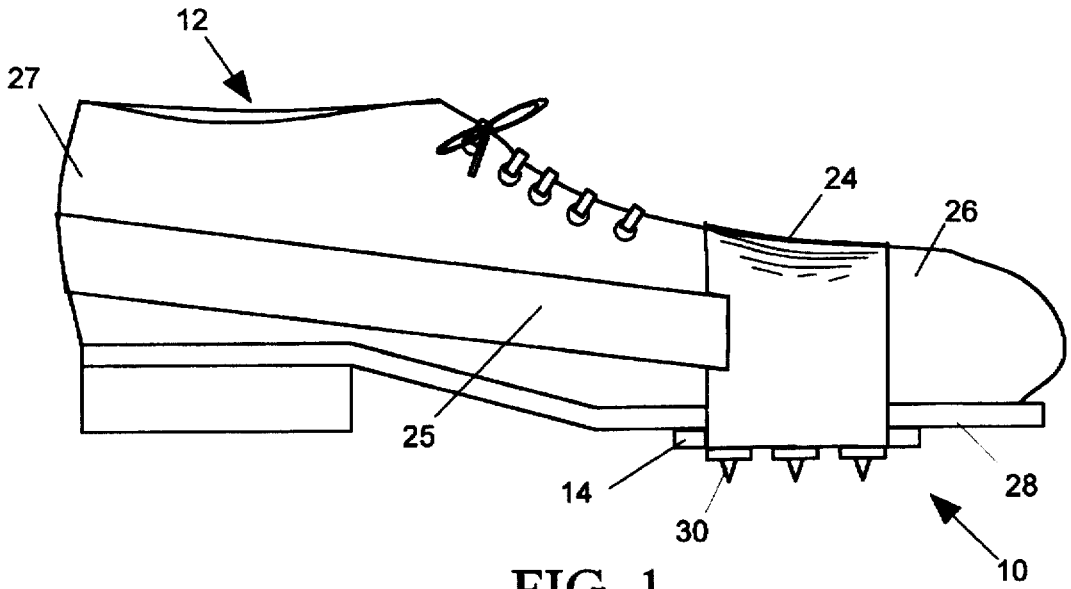
FIG. 1 is a side elevation view of a traction device for a shoe in accordance with the present invention shown mounted on the shoe.
Figure 2:
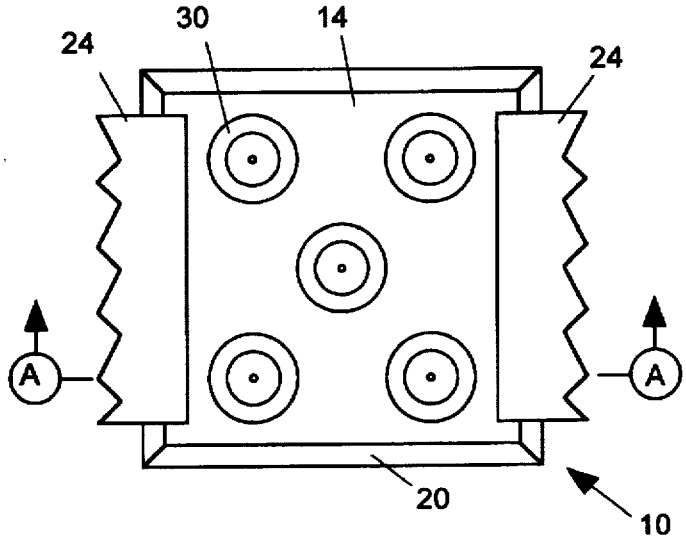
FIG. 2 is a bottom plan view of the traction device of FIG. 1.
Figure 3:
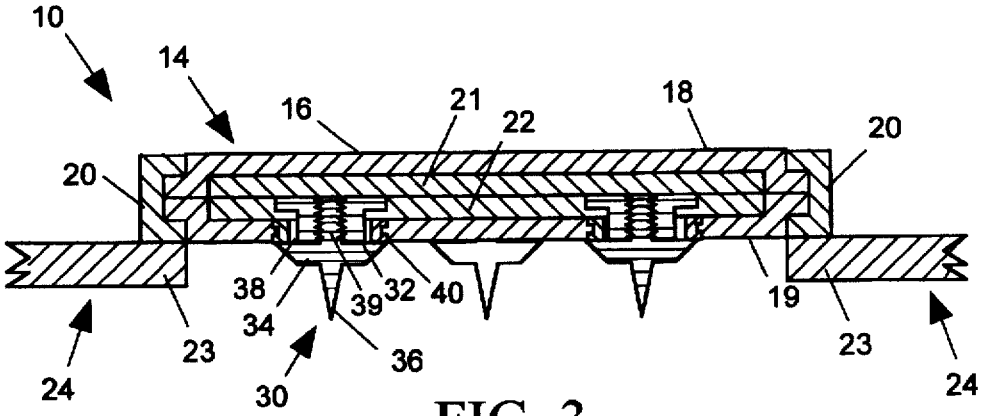
FIG. 3 is a cross section view of the traction device of FIG. 2 taken along section line A—A.

As illustrated in FIGS. 1–3, the present invention is a traction device 10 that may be installed on a shoe 12 to enable a user to walk safely on ice. Traction device 10 includes a pad 14 having an envelope 16 formed by an upper outer layer 18 and a lower outer layer 19 sewn together at their edges through an edge piece 20. Layers 18 and 19 and edge piece 20 are suitably made of tough nylon cloth.

Pad 14 further comprises an upper middle layer 21 and a lower middle layer 22 made of resilient, flexible foam material. Middle layers 21 and 22 are contained within envelope 16 between outer layers 18 and 19. Though contained within envelope 16, middle layers 21 and 22 are not attached to the envelope.

Traction device 10 also includes an elastic band 24 for holding pad 14 on shoe 12. Ends 23 of band 24 are sewn to opposite edges of pad 14 so that band 24 and pad 14 form a loop. The loop is sized so that when the toe portion 26 of shoe 12 is inserted into the loop, pad 14 is held tightly to the sole 28 of shoe 12. A second elastic band 25 having ends sewed to band 24 fits around the rear portion 27 of shoe 12 to help secure band 24 and pad 14 on shoe 12.

Traction device 10 further includes a set of spike assemblies 30. Each spike assembly 30 includes a tapped receiver 32 and a flanged spike 34. Receiver 32 is attached to the lower middle layer 22 of pad 14. Spike 34 has a pointed tip end 36 passing downward through a grommeted hole 38 in lower outer layer 19. A threaded end 39 of spike 34 screws into tapped receiver 32.

Since receivers 32 are attached to the flexible lower middle layer 22 of pad 14, spike assemblies 30 are free to move vertically with respect to one another as necessary to conform to rough ice surfaces. The resilient upper middle layer 21 between spike assemblies 30 and shoe sole 28 allows each spike assembly 30 a range of independent vertical motion. Upper middle layer 21 also helps cushion the user's foot from spike assemblies 30. A grommet 40 is attached to lower outer layer 19. Spike assembly 30, which extends through hole 38 in grommet 40, devoid of attachment to either grommet 40 or envelope 16. Grommet 40 protects lower outer layer 19 from wear due to movement of spike assemblies 30.

Band 24, being elastic, conforms to shoe 12 and firmly attaches pad 14 to shoe 12 regardless of changes in the shape of the shoe as the user walks. Although envelope 16 flexes as the user walks, such flexing does not stress lower middle layer 22, or the bond between receivers 32 and layer 22, because layer 22 floats within envelope 16 and is not directly attached thereto.

Thus has been described a novel traction device for a shoe providing the wearer effective and reliable traction on ice. The traction device is inexpensive to manufacture, easy to install, and easy to carry when not in use. While the forgoing specification has described preferred embodiment(s) of the present invention, one skilled in the art may make many modifications to the preferred embodiment without departing from the invention in its broader aspects. The appended claims therefore are intended to cover all such modifications as fall within the true scope and spirit of the invention.

I claim:

1. An apparatus for a shoe for providing traction on ice comprising:

an envelope, means for attaching the envelope to said shoe, a flexible first layer contained within said envelope; and spike means attached to said first layer and extending though said envelope away from said shoe for engaging said ice, wherein said spike means is devoid of attachment to said envelope.

2. The apparatus in accordance with claim 1 further comprising a resilient second layer contained within said envelope for cushioning said spike means from said shoe when said envelope is attached to said shoe.

3. The apparatus in accordance with claim 1 wherein said spike means comprises:

a receiver attached to said first layer and having a tap therein, and a spike having a threaded end screwed into said tap and a pointed end extending through said envelope away from said shoe for engaging said ice.

4. The apparatus in accordance with claim 1 wherein said envelope comprises two layers of woven material having adjoined edges.

5. An apparatus for a shoe for providing traction on ice comprising:

an envelope, a grommet attached to said envelope, means for attaching the envelope to said shoe, a flexible first layer contained within said envelope; and spike means attached to said first layer, said spike means extending though said grommet and away from said shoe for engaging said ice.

6. The apparatus in accordance with claim 5 further comprising a resilient second layer contained within said envelope for cushioning said spike means from said shoe when said envelope is attached to said shoe.

7. The apparatus in accordance with claim 5 wherein said envelope comprises two layers of woven material having adjoined edges.

8. The apparatus in accordance with claim 5 wherein said spike means comprises:

a receiver attached to said first layer and having a tap therein, and a spike having a threaded end screwed into said tap and a pointed end extending through said grommet away from said shoe for engaging said ice.

9. An apparatus for a shoe for providing traction on ice comprising:

an envelope, a first elastic band attached to said envelope for holding said envelope firmly to said shoe, a flexible first layer contained within said envelope, and spike means attached to said first layer, and a grommet attached to said envelope, said spike means extending though said grommet for engaging said ice.

10. The apparatus in accordance with claim 9 wherein said envelope comprises two layers of woven material having adjoined edges.

11. The apparatus in accordance with claim 9 further comprising a second elastic band having ends attached to said first elastic band for holding said first elastic band on said shoe.

12. The apparatus in accordance with claim 5 wherein said spike means is devoid of attachment to said envelope.

* * * * *